US012473133B2

(12) United States Patent
Nagashima

(10) Patent No.: US 12,473,133 B2
(45) Date of Patent: Nov. 18, 2025

(54) PACKAGE

(71) Applicant: MURATA MANUFACTURING CO., LTD., Kyoto (JP)

(72) Inventor: Hiroshi Nagashima, Kyoto (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 18/590,515

(22) Filed: Feb. 28, 2024

(65) Prior Publication Data

US 2024/0199296 A1 Jun. 20, 2024

Related U.S. Application Data

(63) Continuation of application No. PCT/JP2022/037942, filed on Oct. 11, 2022.

(30) Foreign Application Priority Data

Oct. 15, 2021 (JP) ..... 2021-169909

(51) Int. Cl.
*B65D 75/36* (2006.01)
*B65D 75/56* (2006.01)
(Continued)

(52) U.S. Cl.
CPC ..... *B65D 75/367* (2013.01); *B65D 75/566* (2013.01); *B65D 75/5827* (2013.01); *B65D 85/58* (2013.01); *B65D 2585/88* (2013.01)

(58) Field of Classification Search
CPC ..... B65D 75/367; B65D 75/566; B65D 75/5827; B65D 85/58; B65D 2585/88
(Continued)

(56) References Cited

U.S. PATENT DOCUMENTS 5,203,455 A * 4/1993 Hewelt ..... B65D 75/367 206/460
6,338,407 B2 * 1/2002 Danville ..... B65D 75/327 206/532
6,889,840 B2 * 5/2005 Schein ..... B65D 83/0454 221/133
(Continued)

FOREIGN PATENT DOCUMENTS

JP S5853069 U 4/1983
JP 2001270556 A 10/2001
(Continued)

OTHER PUBLICATIONS

International Search Report of corresponding PCT application PCT/JP2022/037942, dated Dec. 20, 2022.

*Primary Examiner* — Jacob K Ackun
(74) *Attorney, Agent, or Firm* — K&L Gates LLP

(57) ABSTRACT

Provided is a package that suppresses stimulation of a corner portion formed after being individually divided. The package includes a first resin sheet including an accommodating portion that is a first recess in which an accommodated object is accommodated, and a second resin sheet covering the accommodating portion and having a welded region that faces the first resin sheet and is welded to the first resin sheet around the accommodating portion. At a corner portion in which a first side in a first direction appearing on a side surface of the welded region and a second side in a second direction appearing on the side surface of the welded region intersect, a non-welded region where the first resin sheet and the second resin sheet are not welded is provided. In the non-welded region, a gap is provided between a corner portion of the first resin sheet and a corner portion of the second resin sheet.

17 Claims, 17 Drawing Sheets

(51) Int. Cl.
*B65D 75/58* (2006.01)
*B65D 85/58* (2006.01)

(58) Field of Classification Search
USPC ..... 206/704, 703, 538
See application file for complete search history.

(56) References Cited

U.S. PATENT DOCUMENTS 7,828,149 B2 * 11/2010 Kalvelage ..... B65D 75/367 206/532
8,430,244 B2 * 4/2013 Kennedy ..... B65D 75/20 206/703
2002/0153278 A1 * 10/2002 Pirro ..... B65D 73/0092 206/703
2003/0183552 A1 * 10/2003 Schein ..... B65D 73/0092 206/704
2003/0209461 A1 * 11/2003 French ..... B65D 75/327 206/538
2004/0011698 A1 * 1/2004 Gaffney ..... B65D 83/0454 206/704
2005/0269236 A1 * 12/2005 Rohrmus ..... B65D 75/327 206/538
2006/0278558 A1 12/2006 Nivala
2006/0283759 A1 * 12/2006 Nivala ..... B65D 75/5855 206/538
2006/0283760 A1 * 12/2006 Nivala ..... B65D 75/38 206/538
2007/0012592 A1 * 1/2007 Bertsch ..... B65D 75/327 206/534
2012/0080353 A1 * 4/2012 Brenner ..... B65D 75/367 206/704
2012/0305584 A1 * 12/2012 Carson ..... B65D 77/2032 206/534
2013/0161230 A1 * 6/2013 Haering ..... B65D 75/327 206/704
2013/0161231 A1 * 6/2013 Haering ..... B65B 5/02 206/704
2023/0111919 A1 * 4/2023 Braverman ..... B65D 21/0206 206/538

FOREIGN PATENT DOCUMENTS

JP 2004059124 A 2/2004
JP 2008526639 A 7/2008
JP 2012239648 A 12/2012
JP 2017114562 A 6/2017

* cited by examiner

PACKAGE

CROSS REFERENCE TO RELATED APPLICATIONS

The present application is a continuation of PCT patent application no. PCT/JP2022/037942, filed on Oct. 11, 2022, which claims priority to Japanese patent application no. 2021-169909, filed on Oct. 15, 2021, the entire contents of which are incorporated herein by reference.

BACKGROUND

The present disclosure relates to a package.

A blister package is described in which a plurality of pocket portions are alternately arranged in a zigzag manner and divided into a triangular section when cut along a division line.

SUMMARY

The present disclosure relates to a package.

Since the package described in the Background section has a triangular shape, a corner portion appears in an individual package. When it is assumed that the corner portion accidentally hits a finger, there is a demand for reducing stimulation of the corner portion.

The present disclosure, in an embodiment, relates to providing a package that suppresses stimulation of a corner portion formed after being individually divided.

A package according to an embodiment of the present disclosure includes: a first resin sheet including an accommodating portion that is a first recess in which an accommodated object is accommodated; and a second resin sheet covering the accommodating portion and having a welded region that faces the first resin sheet and is welded to the first resin sheet around the accommodating portion, in which at a corner portion in which a first side in a first direction appearing on a side surface of the welded region and a second side in a second direction intersecting the first side appearing on the side surface of the welded region intersect, a non-welded region where the first resin sheet and the second resin sheet face each other and the first resin sheet and the second resin sheet are not welded is provided, and in the non-welded region, a gap is provided between a corner portion of the first resin sheet and a corner portion of the second resin sheet.

A package according to another embodiment of the present disclosure includes: a first resin sheet including at least three or more accommodating portions that are first recesses in which accommodated objects are accommodated, respectively; and a second resin sheet having a welded region facing the first resin sheet and welded to the first resin sheet around the accommodating portion, while covering the accommodating portion, in which among the at least three or more accommodating portions, in a first accommodating portion, a second accommodating portion, and a third accommodating portion adjacent to each other, a first separation line for separating the first accommodating portion and the second accommodating portion adjacent to each other is provided in the welded region, a second separation line for separating the third accommodating portion and the first accommodating portion adjacent to each other and the third accommodating portion and the second accommodating portion is provided in the welded region, a region where the first separation line and the second separation line intersect is a non-welded region where the first resin sheet and the second resin sheet face each other and the first resin sheet and the second resin sheet are not welded, and a gap between the first resin sheet and the second resin sheet is provided in the non-welded region.

According to the present disclosure, it is possible to suppress stimulation of the corner portion formed after individual division.

DETAILED DESCRIPTION

The present disclosure will be described below in further detail including with reference to the drawings according to an embodiment. The present disclosure is not limited to the embodiments described herein. Each embodiment is illustrative, and thus replacement and combination of a part of configurations shown in the different embodiments can be performed. In Embodiment 2 and subsequent embodiments, description of items common to embodiment 1 will be omitted, and only different points will be described. In particular, a similar effect by a similar structure will not be sequentially referred to for each embodiment.

Figure 1:
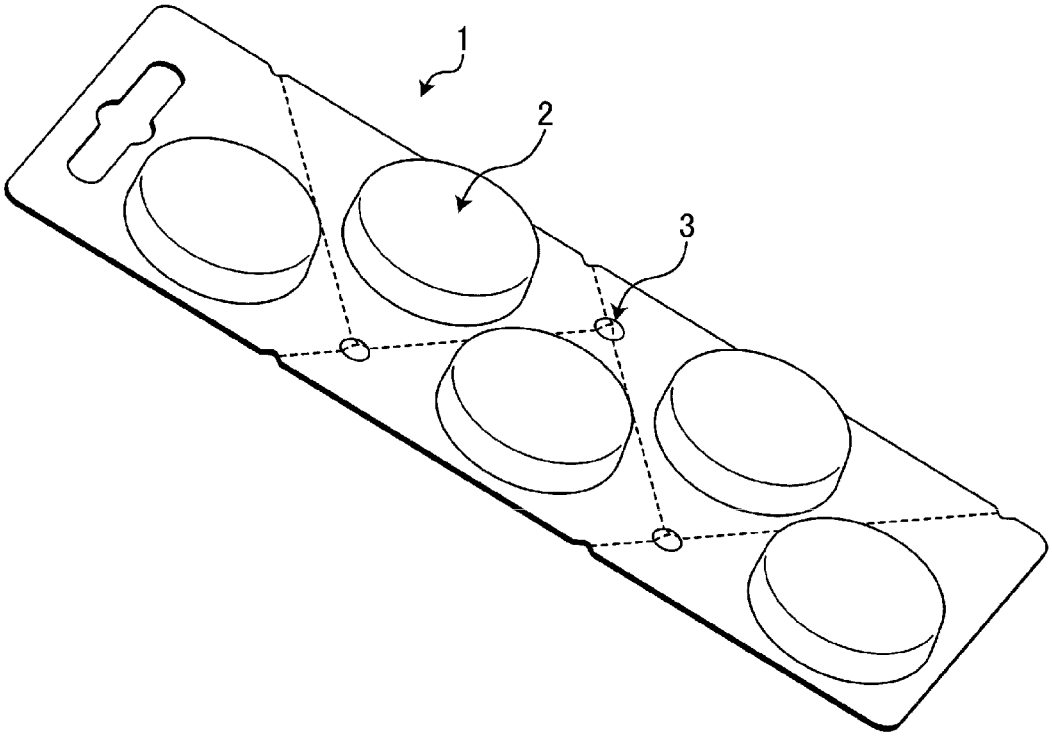
FIG. 1 is a perspective view of a package according to an embodiment.

FIG. 1 is a perspective view of a package according to Embodiment 1. As illustrated in FIG. 1, a package 1 includes a plurality of accommodating portions 2 in which accommodated objects are accommodated. The accommodated object according to Embodiment 1 is a circular battery. The package 1 according to Embodiment 1 can package five batteries. The battery is, for example, a coin-shaped lithium battery (CR 2450). The accommodated object is not limited to a battery, and may be a medicine tablet or the like.

Figure 2:
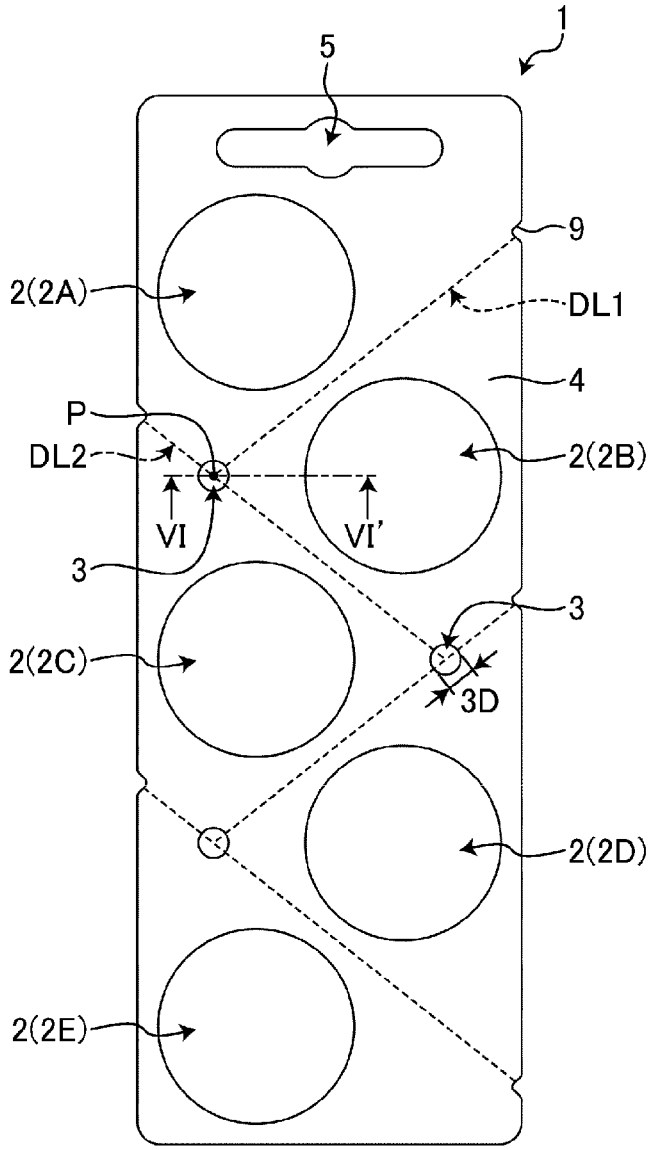
FIG. 2 is a front view of the package according to an embodiment.
Figure 3:
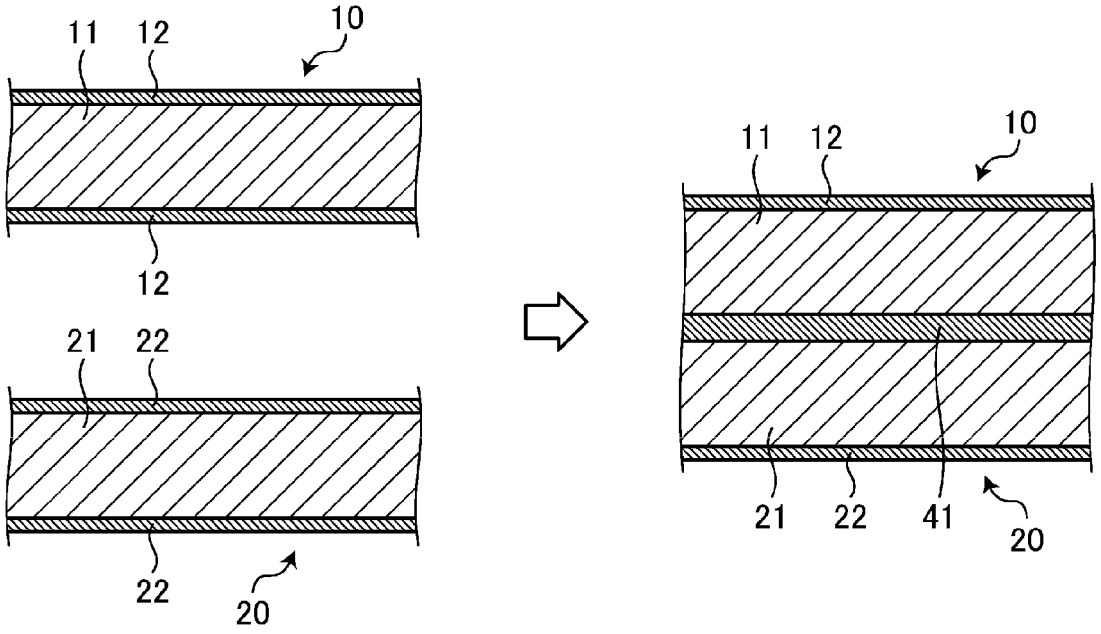
FIG. 3 is an explanatory view for explaining an adhesive layer according to an embodiment.
Figure 4:
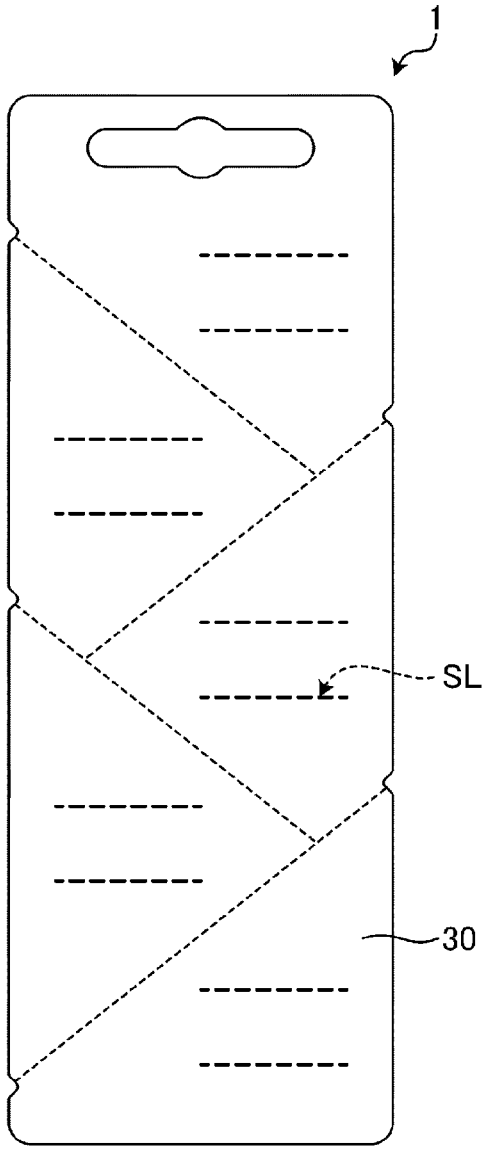
FIG. 4 is a rear view of the package according to an embodiment.
Figure 5:
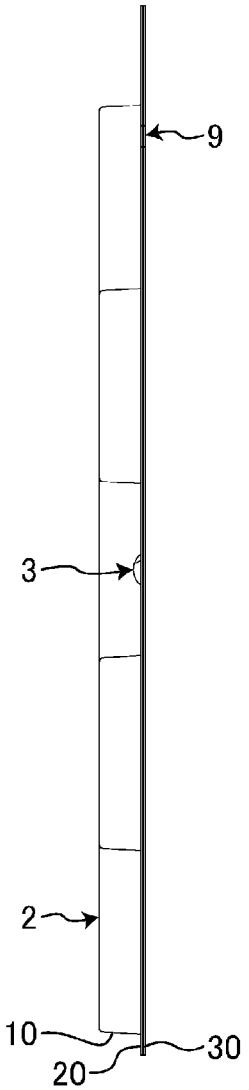
FIG. 5 is a side view of the package according to an embodiment.
Figure 6:
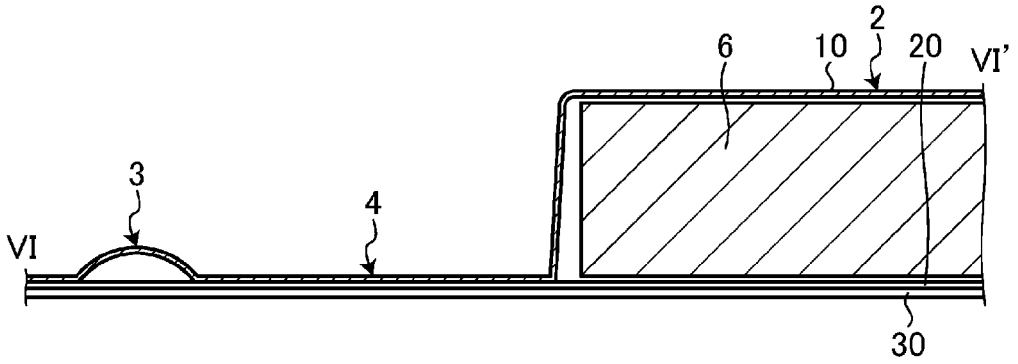
FIG. 6 is a sectional view schematically illustrating a section taken along line VI-VI' of FIG. 2.

FIG. 2 is a front view of the package according to Embodiment 1. FIG. 3 is an explanatory view for explaining an adhesive layer according to Embodiment 1. FIG. 4 is a rear view of the package according to Embodiment 1. FIG. 5 is a side view of the package according to Embodiment 1. FIG. 6 is a sectional view schematically illustrating a section taken along line VI-VI' of FIG. 2.

The package 1 illustrated in FIGS. 1 and 2 is formed by thermally welding a first resin sheet 10 illustrated in FIG. 3, a second resin sheet 20, and a mount 30 illustrated in FIG. 4. The first resin sheet 10 and the second resin sheet 20 face each other. The second resin sheet 20 and the mount 30 face each other. The first resin sheet 10 and the second resin sheet 20 are formed of translucent resin. Here, the resin sheet refers to one obtained by molding a thermoplastic resin composition into a sheet shape. The sheet shape refers to, for example, a planar shape that is extremely thin compared to the length and the width. The sheet may also be referred to as a film.

As illustrated in FIG. 3, the first resin sheet 10 includes a substrate layer 11 of amorphous polyethylene terephthalate, and adhesive layers 12 of, for example, glycol-modified polyethylene terephthalate on both surfaces of the substrate layer 11. Similarly, the second resin sheet 20 includes a substrate layer 21 of amorphous polyethylene terephthalate, and adhesive layers 22 of, for example, glycol-modified polyethylene terephthalate on both surfaces of the substrate layer 21. The adhesive layer 12 of the first resin sheet 10 and the adhesive layer 22 of the second resin sheet 20 are thermally welded by heating to become an adhesive layer 41. As descried above, the first resin sheet 10 and the second resin sheet 20 are thermally welded, and a region where the adhesive layer 41 is present is a welded region 4 illustrated in FIG. 2.

The mount 30 is thick paper serving as a base for attaching a resin sheet when the package 1 is manufactured, and is opaque. There is a case where an adhesive layer is formed in advance on one surface of the mount 30. In addition, characters, pictures, and the like may be printed on the mount 30 in advance. The user can visually recognize characters, pictures, and the like printed on the mount 30 through the first resin sheet 10 and the second resin sheet 20 from the front illustrated in FIG. 2. The package 1 is also referred to as a blister package.

As illustrated in FIG. 4, the mount 30 has a through hole SL at a position overlapping the accommodating portion 2 (see FIG. 2). The first resin sheet 10, the second resin sheet 20, and the mount 30 are overlapped and pressure-bonded at the time of thermal welding. In accordance with the heat at this time, moisture contained in the mount 30 is vaporized to generate water vapor, and there is a possibility that the water vapor deforms the second resin sheet 20 at the position overlapping the accommodating portion 2 (see FIG. 2). In Embodiment 1, since the through hole SL can release water vapor during thermal welding, deformation of the second resin sheet 20 is suppressed. The through hole SL is an intermittent slit of the mount 30.

As illustrated in FIG. 6, the accommodating portion 2 illustrated in FIGS. 1 and 2 is a first recess in which the first resin sheet 10 is recessed. Since the second resin sheet 20 covers the first recess of the accommodating portion 2, an accommodated object 6 is sandwiched between the first resin sheet 10 and the second resin sheet 20.

As illustrated in FIG. 2, the accommodating portion 2 is surrounded by the welded region 4 where the first resin sheet 10 and the second resin sheet 20 are welded. The second resin sheet 20 has the welded region 4 that covers the accommodating portion 2, faces the first resin sheet 10, and is welded to the first resin sheet 10 around the accommodating portion 2.

The plurality of accommodating portions 2 illustrated in FIG. 2 includes an accommodating portion 2A, an accommodating portion 2B, an accommodating portion 2C, an accommodating portion 2D, and an accommodating portion 2E. The accommodating portion 2A, the accommodating portion 2B, the accommodating portion 2C, the accommodating portion 2D, and the accommodating portion 2E are arranged in a zigzag manner. In plan view, there are a first row including the accommodating portion 2A, the accommodating portion 2C, and the accommodating portion 2E and a second row including the accommodating portion 2B and the accommodating portion 2D. The accommodating portion 2B is disposed between the accommodating portion 2A and the accommodating portion 2C, and the accommodating portion 2C is disposed between the accommodating portion 2B and the accommodating portion 2D.

The plurality of accommodating portions 2 illustrated in FIG. 2 are alternately arranged so as to be shifted, and a width in a row direction of the plurality of accommodating portions 2 decreases.

As illustrated in FIG. 2, a first separation line DL1 extending in the first direction and a second separation line DL2 extending in a direction different from the first direction are arranged in the welded region 4. In Embodiment 1, an angle formed by the first separation line DL1 and the second separation line DL2 is 77° or 103°. The first separation line DL1 and the second separation line DL2 are perforations, and the slits intermittently penetrate the first resin sheet 10, the second resin sheet 20, and the mount 30. This makes it easy to cut on a line along the first separation line DL1 and the second separation line DL2.

At a start point of the first separation line DL1 or the second separation line DL2, a cutout 9 is provided, and the cutout 9 guides a position of a scissor blade. As a result, it is easy to cut along the first separation line DL1 or the second separation line DL2.

In the first separation line DL1 and the second separation line DL2, slits formed by half-cutting only the first resin sheet 10 may intermittently penetrate, or slits may intermittently penetrate only the first resin sheet 10 and the second resin sheet 20. The first separation line DL1 and the second separation line DL2 may not be perforations but grooves dug in the surface of the first resin sheet 10. The first separation line DL1 and the second separation line DL2 may be guide lines drawn on the mount 30 instead of being provided on the first resin sheet 10 and the second resin sheet 20.

As illustrated in FIGS. 2 and 6, a region P where the first separation line DL1 and the second separation line DL2 intersect is a region where the first resin sheet 10 and the second resin sheet 20 face each other, and is a non-welded region 3 where the first resin sheet 10 and the second resin sheet 20 are not welded. As illustrated in FIG. 2, a maximum length 3D of the non-welded region 3 on an extension line of the first separation line DL1 (or the second separation line DL2) is 6 mm or less. This makes it difficult to remove the accommodated object 6 by inserting a finger into the non-welded region 3 and peeling the first resin sheet 10 from the second resin sheet 20. As a result, a possibility that the infant or toddler accidentally swallows the accommodated object 6 is reduced.

As illustrated in FIG. 6, the first resin sheet 10 in the non-welded region 3 bulges in a spherical shape in a direction opposite to the second resin sheet 20. There is a gap between the first resin sheet 10 and the second resin sheet 20 in the non-welded region 3.

As illustrated in FIG. 2, the package 1 is provided with a suspension hole 5 penetrating the first resin sheet 10, the second resin sheet 20, and the mount 30, so that the package 1 can be easily displayed.

Figure 7:
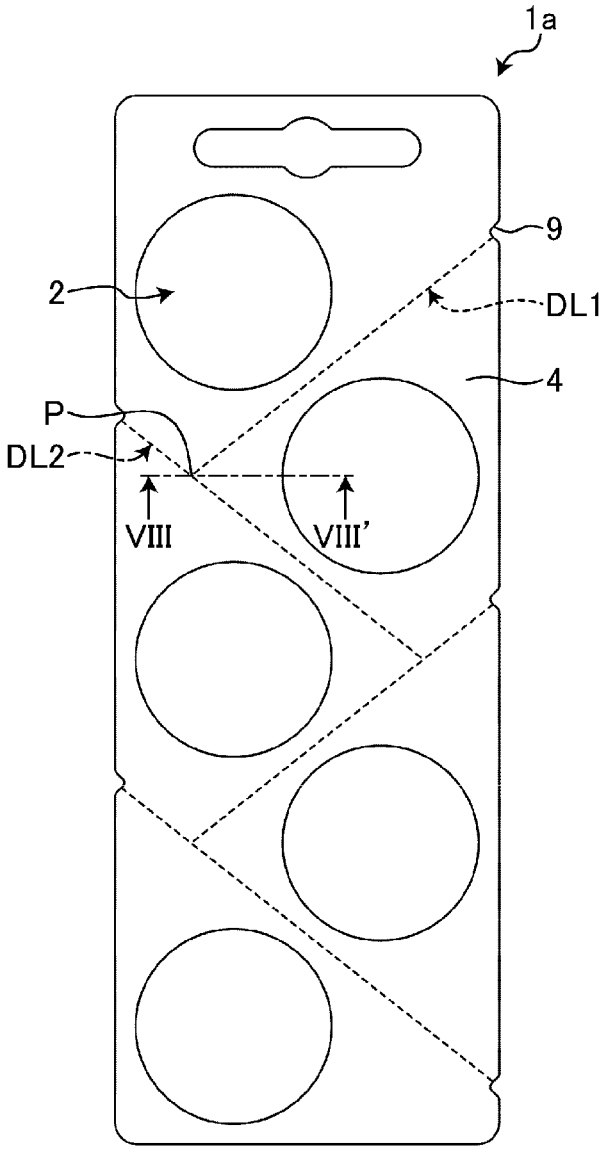
FIG. 7 is a front view of the package according to Comparative Example.
Figure 8:
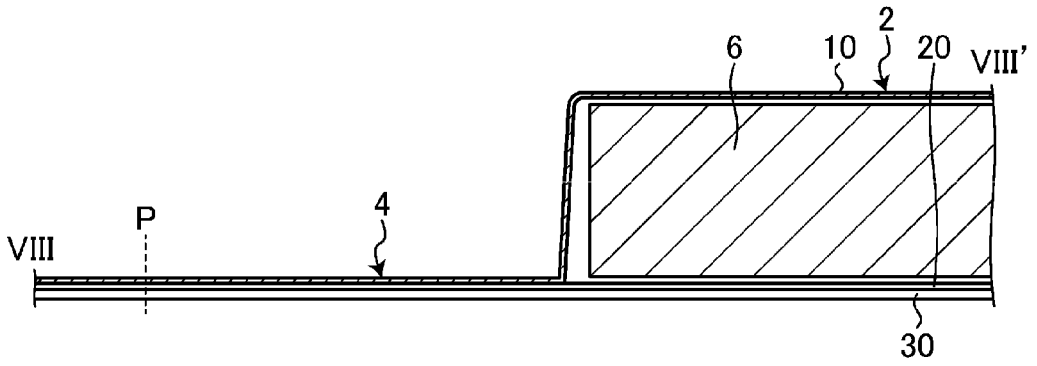
FIG. 8 is a sectional view schematically illustrating a section taken along line VIII-VIII' of FIG. 7.

FIG. 7 is a front view of the package according to Comparative Example. FIG. 8 is a sectional view schematically illustrating a section taken along line VIII-VIII' of FIG. 7. As illustrated in FIGS. 7 and 8, a package 1*a* of Comparative Example does not have the non-welded region 3. As illustrated in FIGS. 7 and 8, the region P where the first separation line DL1 and the second separation line DL2 intersect is the welded region 4. When cutting is performed on the line along the first separation line DL1 and the second separation line DL2, the region P has a total thickness of the first resin sheet 10, the second resin sheet 20, and the mount 30. When cutting is performed on the line along the first separation line DL1 and the second separation line DL2, the region P becomes a corner portion. The corner portion has the total thickness of the first resin sheet 10, the second resin sheet 20, and the mount 30. Thus, a strong protrusion is formed at the corner portion. Each of the first resin sheet 10, the second resin sheet 20, and the mount 30 alone has suitable softness. However, this is because the rigidity is remarkably increased when the two resin sheets are integrated. Therefore, when the corner portion accidentally hits the finger, stimulation to the surface of the skin is large. The corner portion may cause injuries to the finger.

Figure 9:
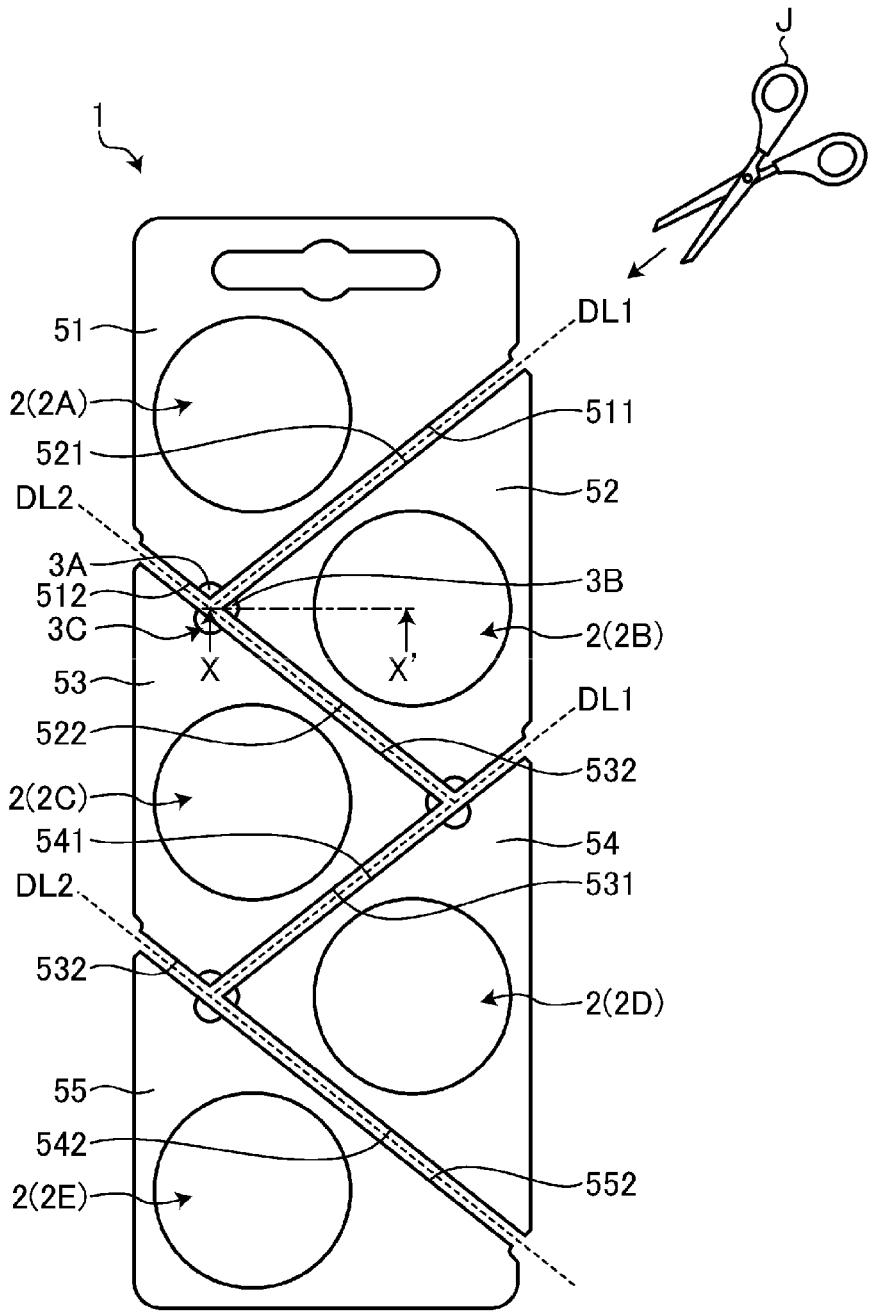
FIG. 9 is an explanatory view for explaining an individual package obtained by dividing the package of FIG. 2.

FIG. 9 is an explanatory view for explaining an individual package obtained by dividing the package of FIG. 2. As illustrated in FIG. 9, the package 1 according to Embodiment 1 becomes individual packages 51, 52, 53, 54, and 55 when cut on the line along the first separation line DL1 and the second separation line DL2. The two first separation lines DL1 in FIG. 9 are parallel to each other, and the two second separation lines DL2 are parallel to each other.

When scissors J cut on the line along the first separation line DL1, a first side 511 appears on a side surface of the welded region 4 of the package 51. When the scissors J cut on the line along the second separation line DL2, a second side 512 appears on the side surface of the welded region 4 of the package 51. A corner portion where the first side 511 and the second side 512 intersect has a non-welded region 3A.

When the scissors J cut on the line along the first separation line DL1, a first side 521 appears on the side surface of the welded region 4 of the package 52. When the scissors J cut on the line along the second separation line DL2, a second side 522 appears on the side surface of the welded region 4 of the package 52. A corner portion where the first side 521 and the second side 522 intersect has a non-welded region 3B.

When the scissors J cut on the line along the first separation line DL1, a first side 531 appears on the side surface of the welded region 4 of the package 53. When the scissors J cut on the line along the second separation line DL2, a second side 532 appears on the side surface of the welded region 4 of the package 53. A semicircular non-welded region 3C remains on the second side 532. In the individual package 53, a non-welded region is formed at a corner portion similarly to the package 51 and the package 52.

When the scissors J cut on the line along the first separation line DL1, a first side 541 appears on the side surface of the welded region 4 of the package 54. When the scissors J cut on the line along the second separation line DL2, a second side 542 appears on the side surface of the welded region 4 of the package 54. In the individual package 54, a non-welded region is formed at a corner portion similarly to the package 51 and the package 52.

When the scissors J cut on the line along the second separation line DL2, a second side 552 appears on the side surface of the welded region 4 of the package 55. A semicircular non-welded region remains on the second side 552.

Figure 10:
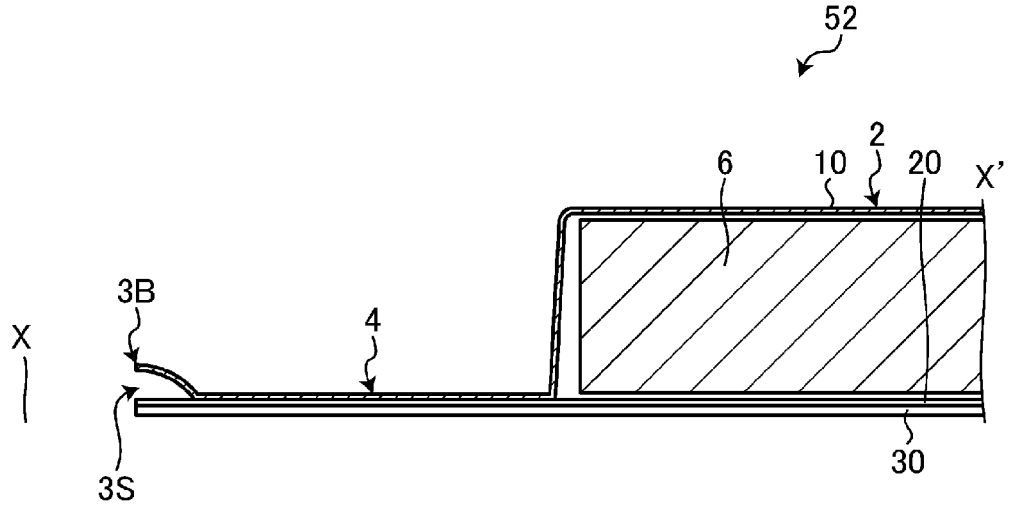
FIG. 10 is a sectional view schematically illustrating a section taken along line X-X' of FIG. 9.

FIG. 10 is a sectional view schematically illustrating a section taken along line X-X' of FIG. 9. In the package 52, a corner portion where the first side 521 and the second side 522 intersect has the non-welded region 3B where the first resin sheet 10 and the second resin sheet 20 are not welded. In the non-welded region 3B, a gap 3S is provided between a corner portion of the first resin sheet 10 and a corner portion of the second resin sheet 20. The thickness of the first resin sheet 10 in the non-welded region 3B is thinner than the thickness of the region P of Comparative Example. The total thickness of the second resin sheet 20 and the mount 30 in the non-welded region 3B is thinner than the thickness of the region P of Comparative Example. As a result, as compared with Comparative Example, the stimulation of the corner portion of the first embodiment is suppressed, and the possibility of injury when the corner portion according to Embodiment 1 accidentally hits the finger is reduced.

As described above, the package 1 according to Embodiment 1 includes the three adjacent accommodating portions 2A, 2B, and 2C. The three adjacent accommodating portions 2A, 2B, and 2C form a triangle when the centers thereof are connected. In a case where the three accommodating portions 2A, 2B, and 2C are not circular, area centers (or area centroids) of the three accommodating portions 2A, 2B, and 2C are connected to each other to form a triangle. The first separation line DL1 that separates the first accommodating portion 2A and the second accommodating portion 2B is provided in the welded region 4. The second separation line DL2 that separates the third accommodating portion 2C and the second accommodating portion 2A is provided in the welded region 4. The region P where the first separation line DL1 and the second separation line DL2 intersect is the non-welded region 3 where the first resin sheet 10 and the second resin sheet 20 are not welded. There is a gap between the first resin sheet 10 and the second resin sheet 20 in the non-welded region 3.

Thus, when the scissors J cut on the line along the first separation line DL1 and the second separation line DL2, the gap 3S can be generated between the corner portion of the first resin sheet 10 and the corner portion of the second resin sheet 20. The corner portion of the first resin sheet 10 and the corner portion of the second resin sheet 20 exist alone, and thus have suitable softness. As compared with Comparative Example, the rigidity of the corner portion according to Embodiment 1 is remarkably low. Therefore, the stimulation to the surface of the skin is suppressed when the corner portion according to Embodiment 1 accidentally hits the finger. The corner portion reduces the possibility of injuries to the finger.

Although the three adjacent accommodating portions 2 are the accommodating portion 2A, the accommodating portion 2B, and the accommodating portion 2C, the same applies to a combination of the accommodating portion 2B, the accommodating portion 2C, and the accommodating portion 2D, or a combination of the accommodating portion 2C, the accommodating portion 2D, and the accommodating portion 2E.

Figure 11:
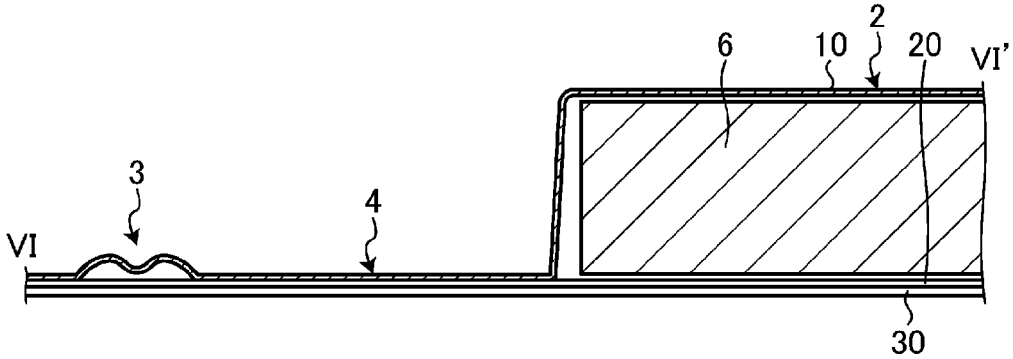
FIG. 11 is a sectional view schematically illustrating another section taken along line V-V' of FIG. 2.

FIG. 11 is a sectional view schematically illustrating another section taken along line V-V' of FIG. 2. As illustrated in FIG. 11, the first resin sheet 10 in the non-welded region 3 is deformed. This deformation is caused by pressing by perforation processing of the first separation line DL1 and the second separation line DL2.

The deformation of the non-welded region 3 makes it difficult to remove the accommodated object 6 by peeling the first resin sheet 10 from the second resin sheet 20 with the non-welded region 3 as a starting point.

Figure 12:
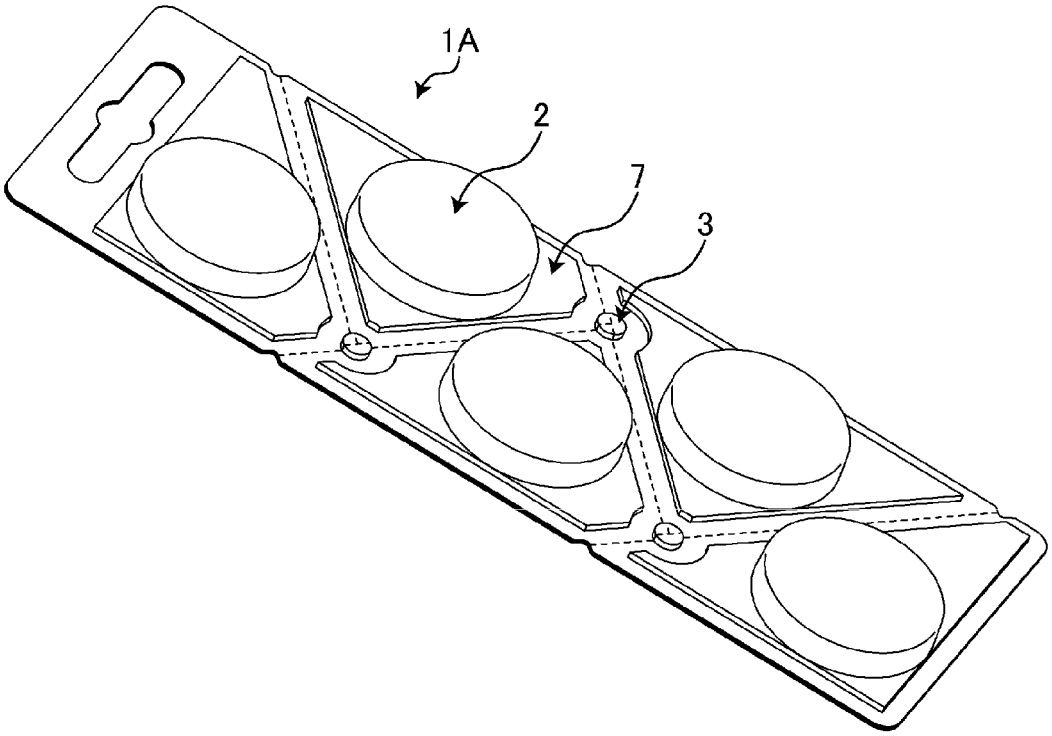
FIG. 12 is a perspective view of a package according to an embodiment.
Figure 13:
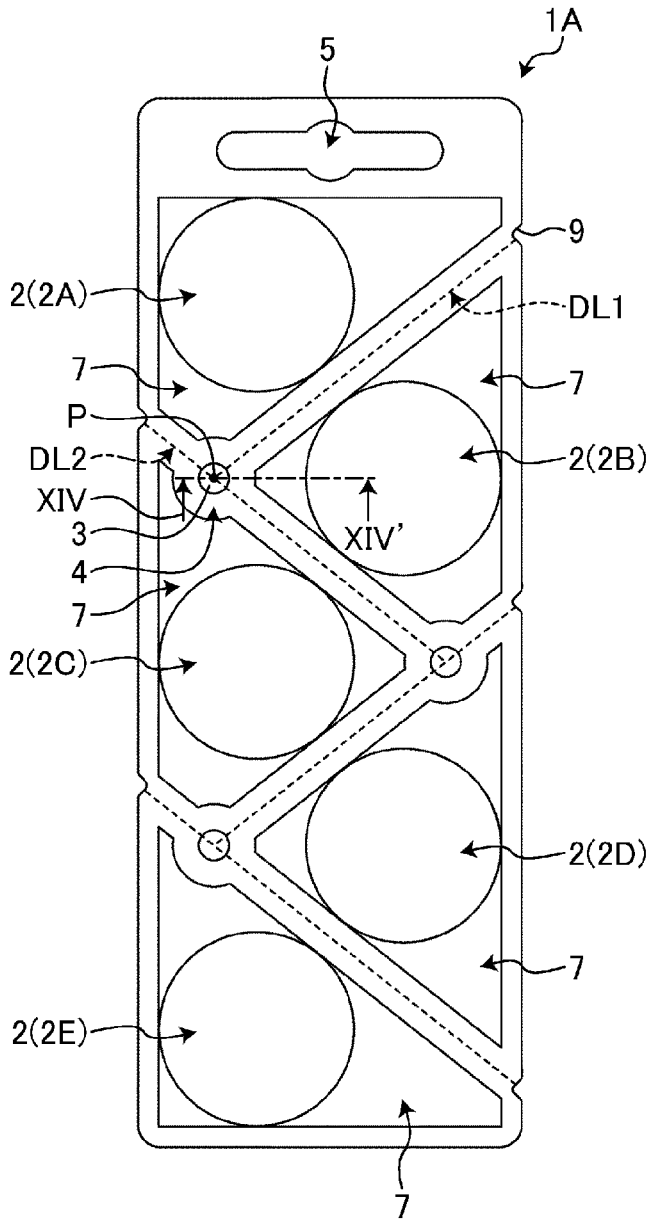
FIG. 13 is a front view of the package according to an embodiment.
Figure 14:
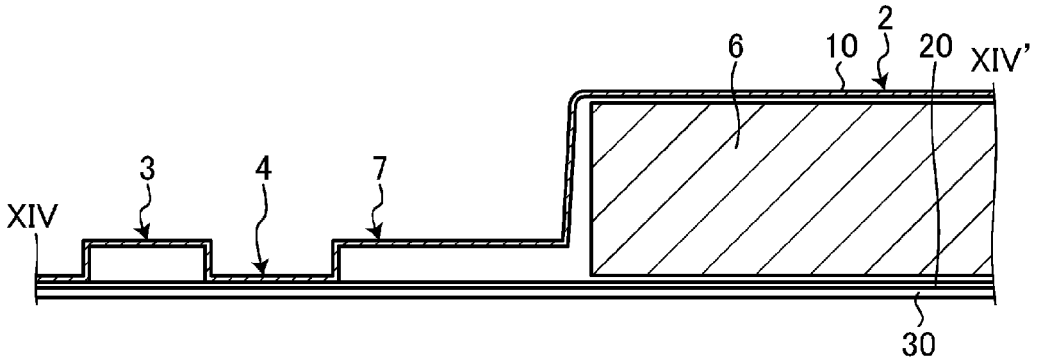
FIG. 14 is a sectional view schematically illustrating a section taken along line XIV-XIV' of FIG. 13.

FIG. 12 is a perspective view of a package according to Embodiment 2. FIG. 13 is a front view of the package according to Embodiment 2. FIG. 14 is a sectional view schematically illustrating a section taken along line XIV-XIV' of FIG. 13. A package 1A according to Embodiment 2 is different from the package 1 according to Embodiment 1 in that the package 1A has a second recess 7. The package 1A according to Embodiment 2 is the same as the package 1 according to Embodiment 1 in the shape of the back surface (see FIG. 4). In Embodiment 2, the same components as those in Embodiment 1 are denoted by the same reference numerals, and a detailed description thereof will be omitted.

As illustrated in FIGS. 12 to 14, the first resin sheet 10 has the second recess 7 having a depth smaller than that of a first recess of an accommodating portion 2 between the first recess of the accommodating portion 2 and a welded region 4.

In Embodiment 1, when scissors cut on a line along a first separation line DL1 and a second separation line DL2, a periphery of the accommodating portion 2 is surrounded by the welded region 4. In this state, the possibility that the infant or toddler accidentally swallows an accommodated object 6 is low, which is preferable; however, the accommodated object 6 is difficult to be taken out.

On the other hand, in Embodiment 2, when the scissors cut on the line along the first separation line DL1 and the second separation line DL2, the periphery of the accommodating portion 2 and a periphery of the second recess 7 are surrounded by the welded region 4. By further cutting a region of the second recess 7 with the scissors, the accommodated object 6 can be easily taken out.

As described above, after the package 1A according to Embodiment 2 is formed into an individual package, the package is cut for the second time with the scissors, so that the accommodated object 6 is easily taken out. As described above, in the package 1A according to Embodiment 2, the number of times of cutting with scissors is plural, so that it is difficult for the infant or toddler to open the package 1A, and the possibility of accidental ingestion by the infant or toddler is reduced.

Figure 15:
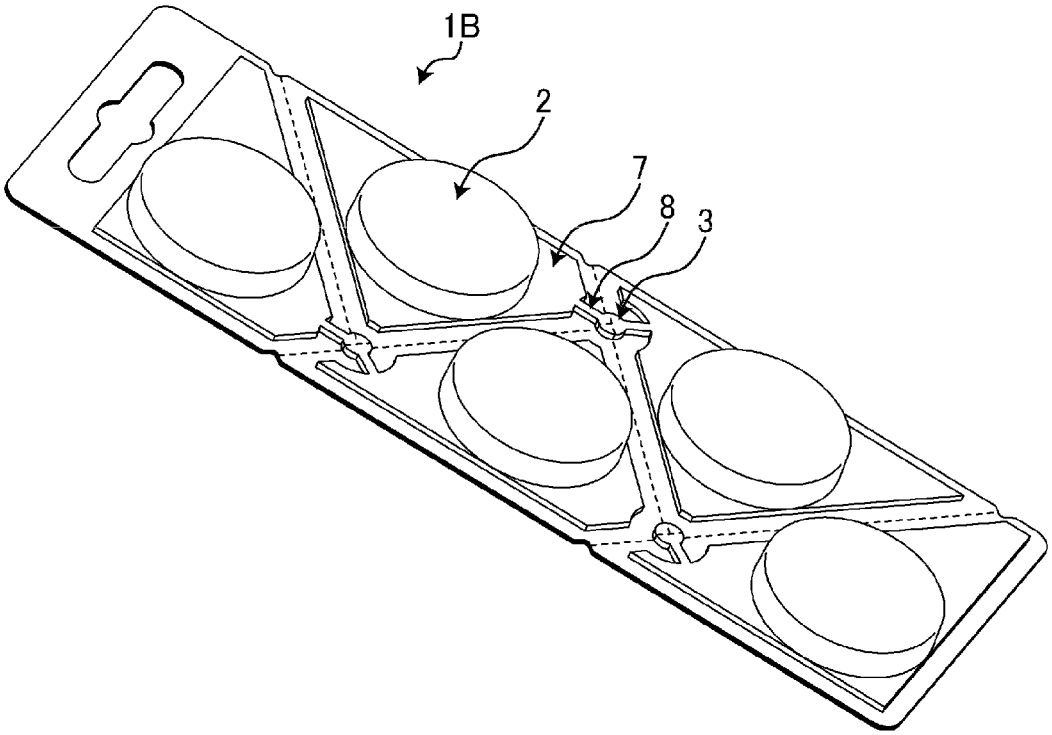
FIG. 15 is a perspective view of a package according an embodiment.
Figure 16:
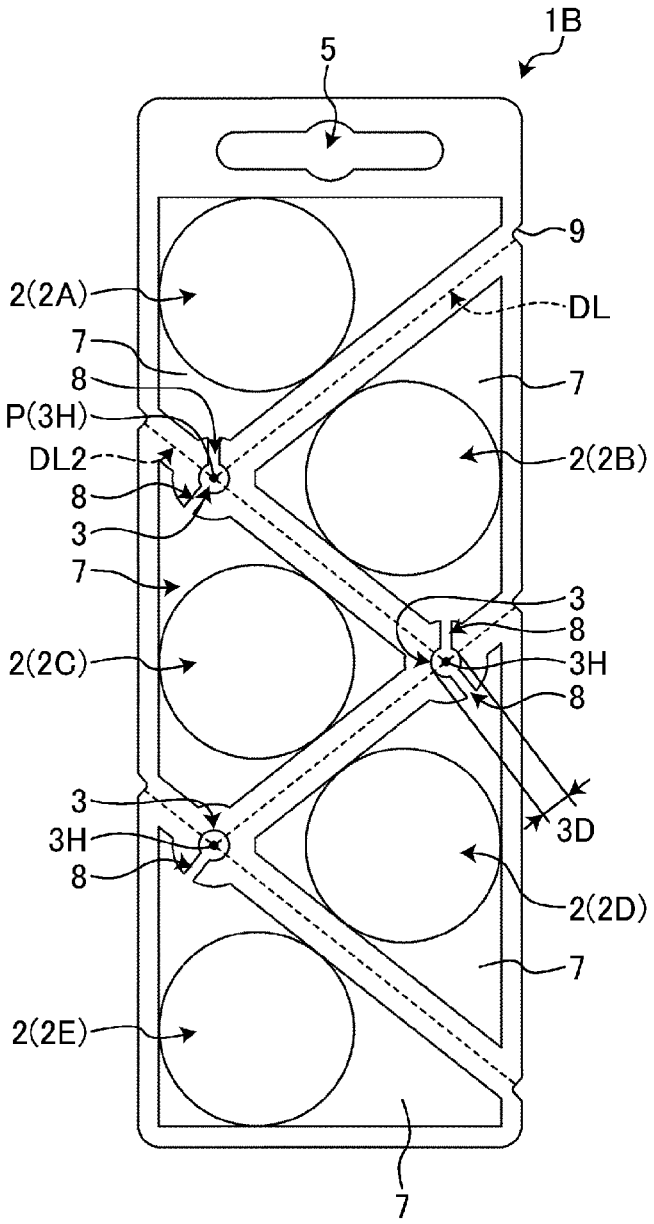
FIG. 16 is a front view of the package according to an embodiment.
Figure 17:
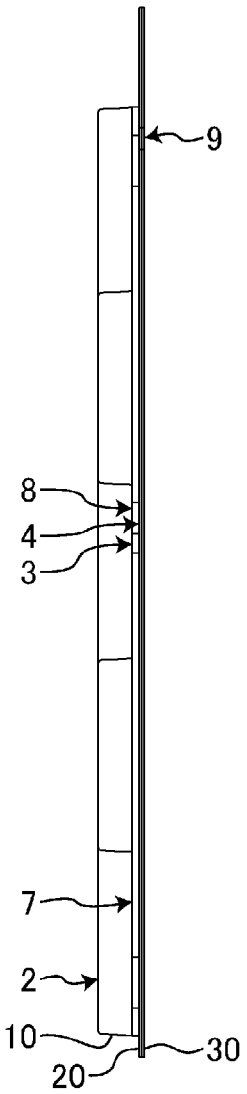
FIG. 17 is a side view of the package according to an embodiment.
Figure 18:
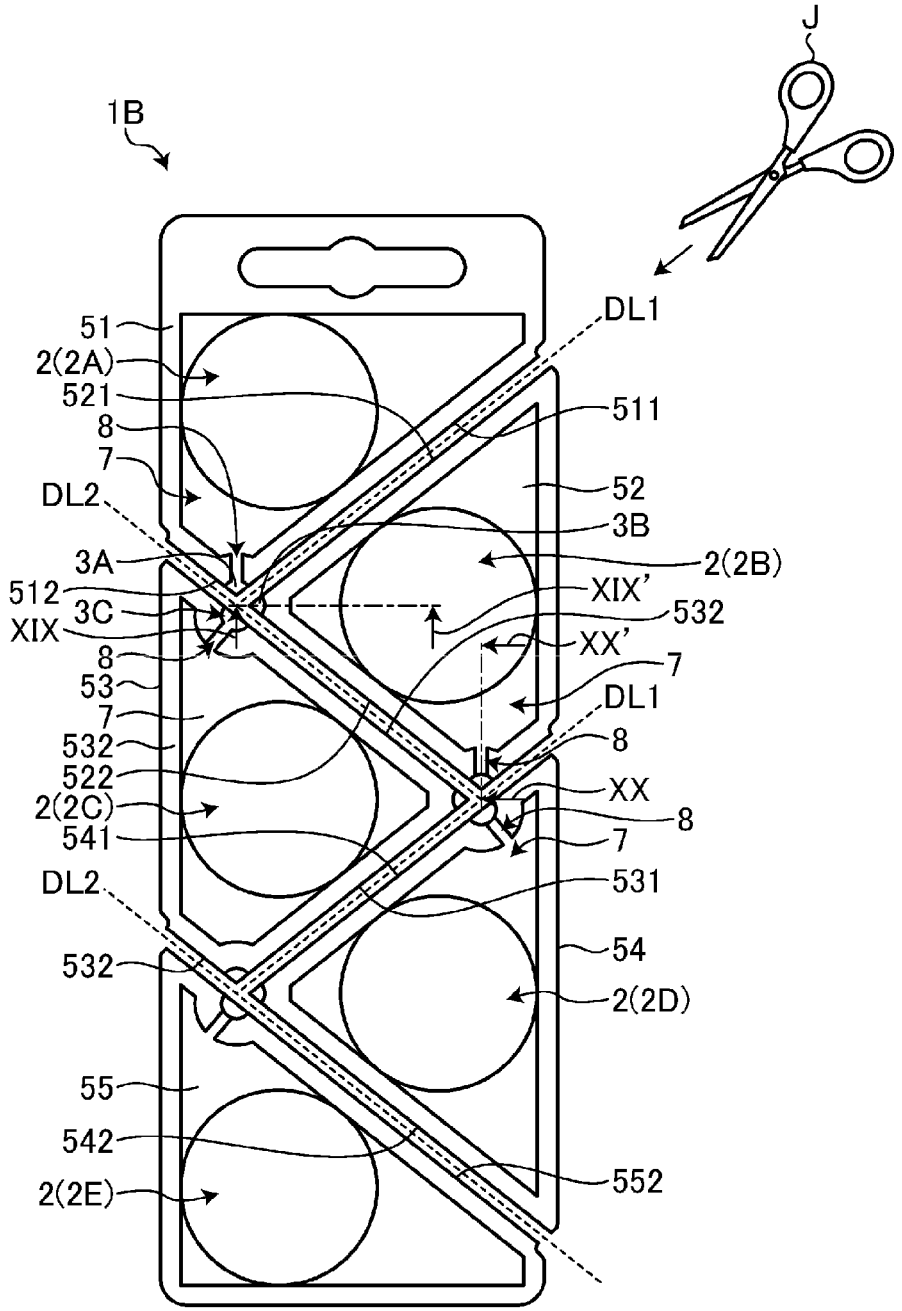
FIG. 18 is an explanatory view for explaining an individual package obtained by dividing the package of FIG. 16.
Figure 19:
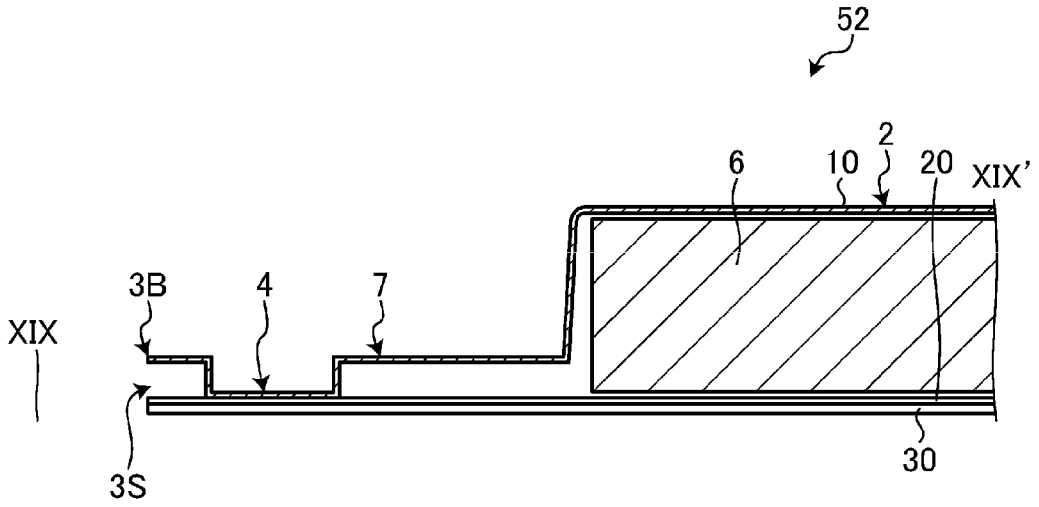
FIG. 19 is a sectional view schematically illustrating a section taken along line XIX-XIX' of FIG. 18.
Figure 20:
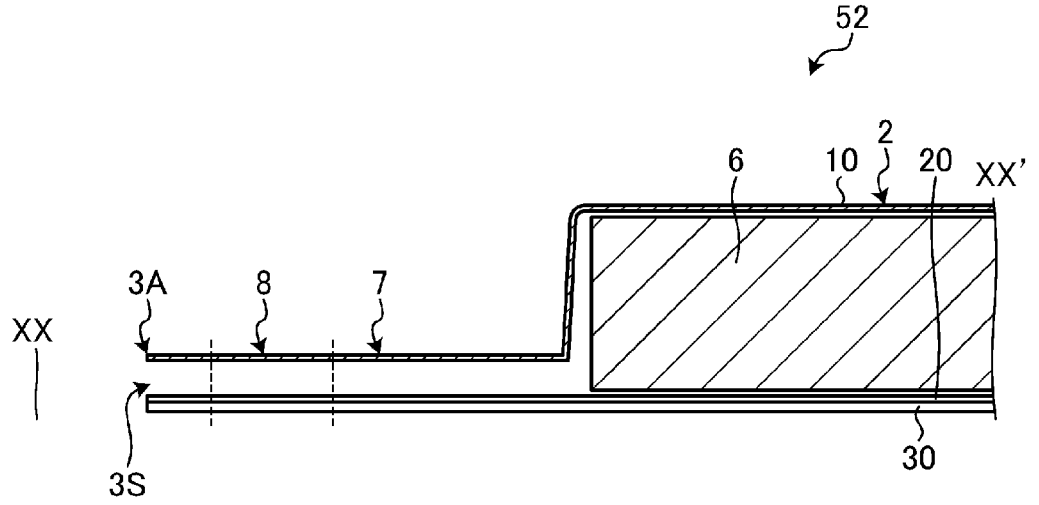
FIG. 20 is a sectional view schematically illustrating a section taken along line XX-XX' of FIG. 18.

FIG. 15 is a perspective view of a package according to Embodiment 3. FIG. 16 is a front view of the package according to Embodiment 3. FIG. 17 is a side view of the package according to Embodiment 3. FIG. 18 is an explanatory view for explaining an individual package obtained by dividing the package of FIG. 16. FIG. 19 is a sectional view schematically illustrating a section taken along line XIX-XIX' of FIG. 18. FIG. 20 is a sectional view schematically illustrating a section taken along line XX-XX' of FIG. 18. A package 1B according to Embodiment 3 is different from the package 1A according to Embodiment 2 in that a communication portion 8 is provided. The package 1B according to Embodiment 3 is the same as the package 1 according to Embodiment 1 in the shape of the back surface (see FIG. 4). In Embodiment 3, the same components as those in Embodiments 1 and 2 are denoted by the same reference numerals, and a detailed description thereof will be omitted.

As illustrated in FIGS. 15 to 18, a first resin sheet 10 includes the communication portion 8 in which an internal space of a second recess 7 communicates with a gap of a non-welded region 3. In FIG. 19, the first resin sheet 10 has the second recess 7 having a depth smaller than that of a first recess of an accommodating portion 2 between the first recess of the accommodating portion 2 and a welded region 4.

In FIG. 20, since the internal space of the second recess 7 communicates with the gap of the non-welded region 3, air easily flows. When the first resin sheet and the second resin sheet are overlapped and thermally welded, there is an effect that the air inside the non-welded region 3 flows without being confined, and abnormal deformation of the package 1B does not occur.

Since the internal space of the second recess 7 communicates with the gap of the non-welded region 3 at the time of bending along the perforation of the first separation line DL1 or the second separation line DL2, the air easily flows. Thus, breakage of the non-welded region 3 in an unintended shape is suppressed.

As illustrated in FIG. 18, the communication portion 8 does not intersect the first separation line DL1 and the second separation line DL2. Thus, when the scissors J cut the non-welded region 3 on the line along the first separation line DL1 and the second separation line DL2, the communication portion 8 is not cut. Even if a portion other than the first separation line DL1 and the second separation line DL2 is cut with the scissors J and the communication portion 8 is cut, an opening larger than the maximum length 3D (see FIG. 16) of the non-welded region 3 does not occur. Thus, the width of the communication portion 8 is equal to or less than the maximum length 3D of the non-welded region 3.

As illustrated in FIG. 16, the first resin sheet 10 in the non-welded region 3 according to Embodiment 3 has a hole 3H. The first resin sheet 10, the second resin sheet 20, and the mount 30 are overlapped and pressure-bonded at the time of thermal welding. The air existing between the first resin sheet 10 and the second resin sheet 20 may deform the shape of the accommodating portion 2 of the first resin sheet 10 according to the heat at this time. In Embodiment 3, the non-welded region 3 and the accommodating portion 2 communicate with each other via the communication portion 8. Thus, if the air expands between the first resin sheet 10 and the second resin sheet 20 at the time of thermal welding, the air is discharged to the outside from the hole 3H, so that the shape of the accommodating portion 2 of the first resin sheet 10 is hardly deformed. The hole 3H may be a slit.

Evaluation Example

The package 1B according to Embodiment 3 was manufactured as Examples 1 to 15. In Examples 1 to 15, the thicknesses [mm] of the first resin sheet 10, the second resin sheet 20, and the mount 30 are different as shown in Table 1. The accommodated object of Examples 1 to 15 is a coin-shaped lithium battery (CR 2450).

The package 1*a* of Comparative Example illustrated in FIGS. 7 and 8 was manufactured as Comparative Examples 1 to 5. The package 1*a* of Comparative Example has the same size as the package 1B according to Embodiment 3, and does not have the non-welded region 3, the second recess 7, and the communication portion 8. In Comparative Examples 1 to 5, the thicknesses [mm] of the first resin sheet 10, the second resin sheet 20, and the mount 30 are different as shown in Table 1. The accommodated object of Comparative Examples 1 to 5 is a coin-shaped lithium battery (CR 2450).

After the accommodating portion 2 of each of the first resin sheets 10 of Examples 1 to 15 and Comparative Examples 1 to 5 was formed by vacuum molding, a molding state was visually inspected. As a result of the inspection, a state including the accommodating portion 2 as designed and a state having no unintended partial breakage in the first resin sheet 10 were evaluated as A. A state in which the resin stretched, the accommodating portion 2 was deformed, and the accommodating portion 2 was not as designed, and a state in which the first resin sheet 10 had an unintended partial tear were evaluated as B. In the A evaluation, "o" was added to the column of moldability of the cover in Table 1, and in the B evaluation, "x" was added to the column of moldability of the cover in Table 1.

After the package 1B according to Embodiment 3 and the package 1*a* of Comparative Example were manufactured, Examples 1 to 15 and Comparative Examples 1 to 5 were manufactured as individual packages. In Examples 1 to 15 and Comparative Examples 1 to 5, the prevention of accidental ingestion was evaluated, a piercing test was evaluated, taking out of the battery was evaluated, and warpage of the package was evaluated.

In evaluating the prevention of accidental ingestion, a test was conducted based on the package for preventing accidental ingestion of the coin-type lithium battery primary battery of JIS C 8513, and a battery satisfying the determination criterion was evaluated as A, and a battery not satisfying the determination criterion was evaluated as B. In the A evaluation, "o" was added to the column of the prevention of accidental ingestion in Table 1, and in the B evaluation, "x" was added to the column of the prevention of accidental ingestion in Table 1.

Figure 21:
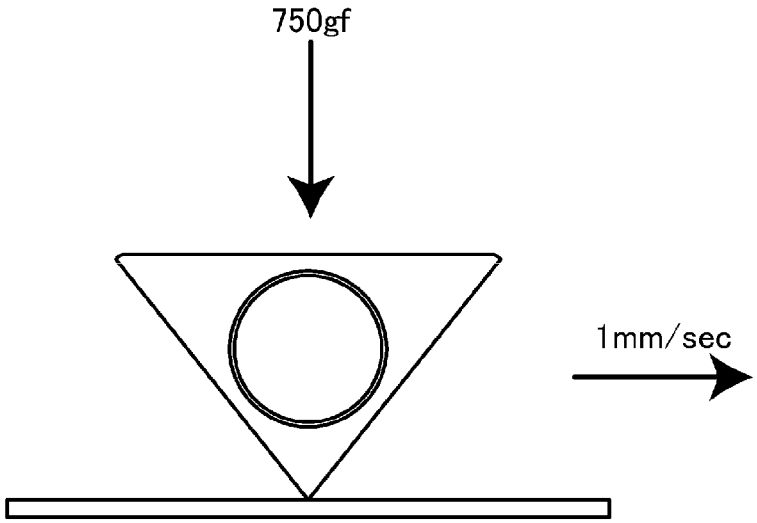
FIG. 21 is an explanatory view schematically illustrating a piercing test.

FIG. 21 is an explanatory view schematically illustrating the piercing test. The piercing test is evaluated based on JIS K 5600-5-4 scratch hardness (pencil method). In a pencil hardness tester, as a test piece illustrated in FIG. 21, each of Examples 1 to 15 and Comparative Examples 1 to 5 is set instead of a pencil. Each corner portion of Examples 1 to 15 and Comparative Examples 1 to 5 is abutted against a test plate of a polyethylene terephthalate sheet (thickness: 0.08 mm) in a stretched state without wrinkles or slack, and moves in parallel on the test plate at a speed of 1 mm/sec with a load of 750 g. The test plate after parallel movement was visually observed, the test plate having no scratches, tears, or scratch tracks was evaluated as A, and the test plate having scratches, tears, or scratch tracks was evaluated as B. In the A evaluation, "o" was added to the column of the piercing in Table 1, and in the B evaluation, "x" was added to the column of the piercing in Table 1.

In evaluating the taking out of the battery, a package in which the content could be taken out by easily cutting the package with scissors was evaluated as A, and a package in which a larger force than usual was required when the package was cut with scissors was evaluated as B. In the A evaluation, "o" was added to the column of the taking out of the battery in Table 1, and in the B evaluation, "x" was added to the column of the taking out of the battery in Table 1.

In evaluating the warpage, each of the packages of Examples 1 to 15 and Comparative Examples 1 to 5 was placed on a flat table, and a state of warpage was visually checked. A package having no warpage was evaluated as A, and a package having warpage was evaluated as B. In the A evaluation, "o" was added to the column of the warpage in Table 1, and in the B evaluation, "x" was added to the column of the warpage in Table 1.

TABLE 1

| | | Examples | | | | | | | | | | | | | | | Comparative Examples | | | | |
|---|---|---|---|---|---|---|---|---|---|---|---|---|---|---|---|---|---|---|---|---|---|
| | | 1 | 2 | 3 | 4 | 5 | 6 | 7 | 8 | 9 | 10 | 11 | 12 | 13 | 14 | 15 | 1 | 2 | 3 | 4 | 5 |
| Material thickness | First resin sheet (mm) | 0.05 | 0.08 | 0.1 | 0.1 | 0.15 | 0.15 | 0.15 | 0.2 | 0.25 | 0.3 | 0.3 | 0.5 | 0.5 | 0.5 | 0.7 | 0.15 | 0.3 | 0.3 | 0.5 | 0.7 |
| | Second resin sheet (mm) | 0.05 | 0.08 | 0.1 | 0.3 | 0.08 | 0.15 | 0.3 | 0.2 | 0.08 | 0.08 | 0.3 | 0.1 | 0.3 | 0.5 | 0.7 | 0.15 | 0.08 | 0.3 | 0.5 | 0.7 |
| | Resin total (mm) | 0.10 | 0.16 | 0.2 | 0.4 | 0.23 | 0.3 | 0.45 | 0.4 | 0.33 | 0.38 | 0.6 | 0.6 | 0.8 | 1.0 | 1.4 | 0.30 | 0.38 | 0.6 | 1.0 | 1.4 |
| | Mount (mm) | 0.2 | 0.2 | 0.2 | 0.2 | 0.2 | 0.2 | 0.2 | 0.2 | 0.2 | 0.2 | 0.2 | 0.2 | 0.2 | 0.2 | 0.2 | 0.2 | 0.2 | 0.2 | 0.2 | 0.2 |
| | Total (mm) | 0.3 | 0.36 | 0.4 | 0.6 | 0.43 | 0.5 | 0.65 | 0.6 | 0.53 | 0.58 | 0.8 | 0.8 | 1.0 | 1.2 | 1.6 | 0.5 | 0.58 | 0.8 | 1.2 | 1.6 |
| | Resin total/mount ratio | 0.5 | 0.8 | 1.0 | 2.0 | 1.2 | 1.5 | 2.3 | 2.0 | 1.7 | 1.9 | 3.0 | 3.0 | 4.0 | 5.0 | 7.0 | 1.5 | 1.9 | 3.0 | 5.0 | 7.0 |
| Moldability of cover | | x | x | x | x | ○ | ○ | ○ | ○ | ○ | ○ | ○ | ○ | ○ | ○ | ○ | ○ | ○ | ○ | ○ | ○ |
| Evaluation | Accidental ingestion prevention | x | ○ | ○ | ○ | ○ | ○ | ○ | ○ | ○ | ○ | ○ | ○ | ○ | ○ | ○ | ○ | ○ | ○ | ○ | ○ |

TABLE 1-continued

| | Examples | | | | | | | | | | | | | | | Comparative Examples | | | | |
|---|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 1 | 2 | 3 | 4 | 5 |
| Piercing | ○ | ○ | ○ | ○ | ○ | ○ | ○ | ○ | ○ | ○ | ○ | x | x | x | x | x | x | x | x | x |
| Taking out of battery | ○ | ○ | ○ | ○ | ○ | ○ | ○ | ○ | ○ | ○ | ○ | ○ | ○ | ○ | x | ○ | ○ | ○ | ○ | x |
| Warpage of package | x | x | ○ | ○ | ○ | ○ | ○ | ○ | ○ | ○ | ○ | ○ | ○ | ○ | ○ | ○ | ○ | ○ | ○ | ○ |

According to Table 1, by setting the thickness of the first resin sheet 10 to 0.15 mm or more and 0.30 mm or less, deformation of the accommodating portion and breakage of the first resin sheet 10 can be suppressed.

According to Table 1, by setting the thickness of the first resin sheet 10 to 0.15 mm or more and 0.30 mm or less and setting the thickness of the second resin sheet 20 to 0.08 mm or more and 0.30 mm or less, it is possible to satisfy the determination criteria for the package for preventing accidental ingestion of the coin-type lithium battery primary battery.

According to Table 1, since the total of the thickness of the first resin sheet 10 and the thickness of the second resin sheet 20 in the welded region 4 is 1 mm or less, it is easy to cut with general scissors for office use or the like, and it is easy to take out the battery with the scissors.

According to Table 1, since a ratio of the total of the thickness of the first resin sheet 10 and the thickness of the second resin sheet 20 to the thickness of the mount 30 in the welded region 4 is 1 or more, warpage can be suppressed.

Figure 22:
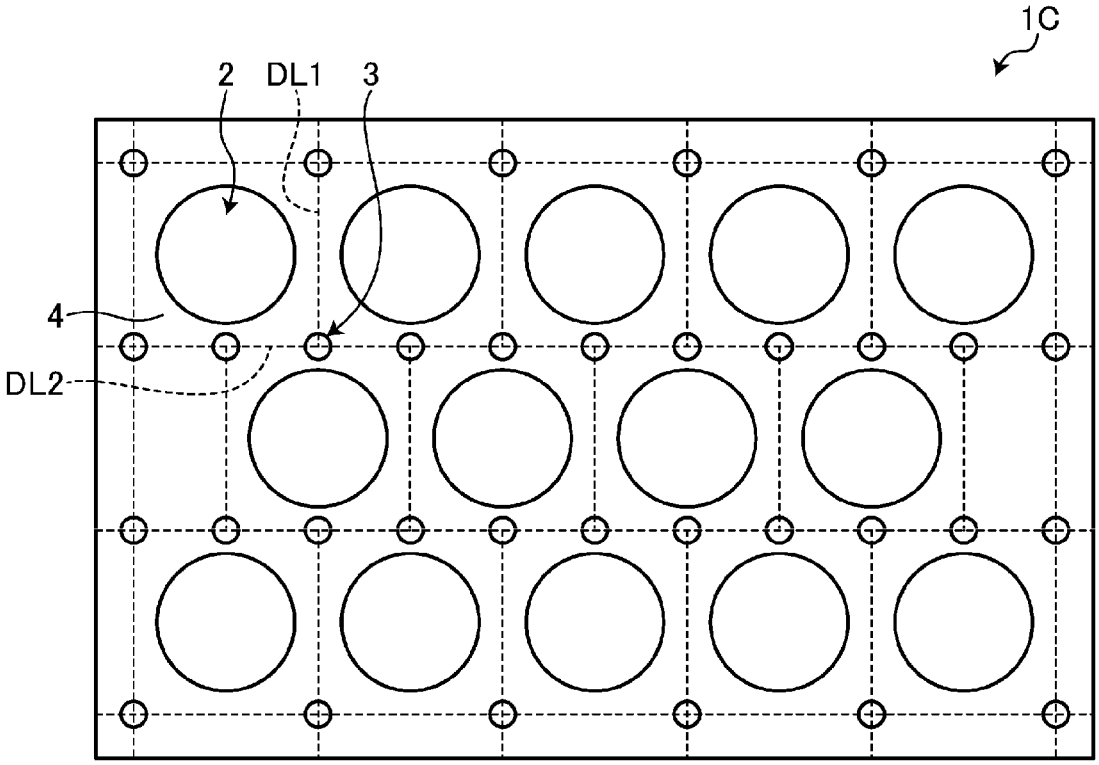
FIG. 22 is a front view of a package according to an embodiment.

FIG. 22 is a front view of the package according to Embodiment 4. A package 1C according to Embodiment 4 is different from the package 1 according to Embodiment 1 in that the angle formed by the first separation line DL1 and the second separation line DL2 is 90°. In Embodiment 4, the same components as those in Embodiments 1, 2, and 3 are denoted by the same reference numerals, and a detailed description thereof will be omitted.

As illustrated in FIG. 22, the first separation line DL1 extending in the first direction and the second separation line DL2 extending in a direction different from the first direction are arranged in the welded region 4 of the package 1C of Embodiment 4. The first direction and the second direction intersect at a right angle. Thus, when the first separation line DL1 and the second separation line DL2 are cut, an individual package becomes rectangular.

Accommodating portions 2 of the package 1C of Embodiment 4 are arranged in a zigzag manner. The plurality of accommodating portions 2 have nine columns and three rows.

Note that the embodiments described above are intended to facilitate understanding of the present disclosure, but not intended to construe the present disclosure in any limited way. The present disclosure may be modified/improved without departing from the spirit thereof, and the present disclosure includes equivalents thereof.

DESCRIPTION OF REFERENCE SYMBOLS

1, 1A, 1B, 1C, 1*a*: Package
2: Accommodating portion
3, 3A, 3B, 3C: Non-welded region
3H: Pore
3S: Gap
4: Welded region
6: Accommodated object
7: Second recess
8: Communication portion
10: First resin sheet
20: Second resin sheet
30: Mount
51, 52, 53, 54, 55: Package
511, 521, 531, 541: First side
512, 522, 532, 542, 552: Second side
DL1: First separation line
DL2: Second separation line
J: Scissors
P: Region
SL: Through hole It should be understood that various changes and modifications to the embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A package comprising:

a first resin sheet including an accommodating portion that is a first recess in which an accommodated object is accommodated; and a second resin sheet covering the accommodating portion and having a welded region that faces the first resin sheet and is welded to the first resin sheet around the accommodating portion, wherein at a corner portion in which a first side in a first direction appearing on a side surface of the welded region and a second side in a second direction intersecting the first side appearing on the side surface of the welded region intersect, a non-welded region where the first resin sheet and the second resin sheet face each other and the first resin sheet and the second resin sheet are not welded is provided, and in the non-welded region, a gap is provided between a corner portion of the first resin sheet and a corner portion of the second resin sheet, and wherein the accommodating portion is entirely surrounded by the welded region.

2. The package according to claim 1, further comprising a mount bonded to the second resin sheet, wherein the mount has a through hole at a position overlapping the accommodating portion.

3. The package according to claim 1, wherein the first resin sheet includes a second recess having a depth smaller than a depth of the first recess between the first recess and the welded region.

4. The package according to claim 3, wherein the first resin sheet includes a communication portion in which an internal space of the second recess communicates with a gap of the non-welded region.

5. The package according to claim 1, wherein the first resin sheet in the non-welded region has a hole or a slit.

6. The package according to claim 1, wherein the first resin sheet has a thickness of 0.15 mm or more and 0.30 mm or less, and a thickness of the second resin sheet is 0.08 mm or more and 0.30 mm or less.

7. The package according to claim 1, wherein a total of a thickness of the first resin sheet and a thickness of the second resin sheet in the welded region is 1 mm or less.

8. The package according to claim 1, further comprising a mount bonded to the second resin sheet, wherein a ratio of the total of the thickness of the first resin sheet and the thickness of the second resin sheet to a thickness of the mount in the welded region is 1 or more.

9. The package according to claim 1, wherein each of the first resin sheet and the second resin sheet includes a substrate layer and adhesive layers formed on both surfaces of the substrate layer.

10. The package according to claim 1, wherein the accommodated object is a battery.

11. A package comprising:

a first resin sheet including at least three or more accommodating portions that are first recesses in which accommodated objects are accommodated, respectively; and a second resin sheet having a welded region facing the first resin sheet and welded to the first resin sheet around the accommodating portion, while covering the accommodating portion, wherein among the at least three or more accommodating portions, in a first accommodating portion, a second accommodating portion, and a third accommodating portion directly adjacent to each other, a first separation line for separating the first accommodating portion and the second accommodating portion directly adjacent to each other is provided in the welded region, a second separation line for separating the third accommodating portion and the first accommodating portion directly adjacent to each other and the third accommodating portion and the second accommodating portion directly adjacent to each other is provided in the welded region, a region where the first separation line and the second separation line intersect is a non-welded region where the first resin sheet and the second resin sheet face each other and the first resin sheet and the second resin sheet are not welded, and a gap between the first resin sheet and the second resin sheet is provided in the non-welded region, and wherein the first separation line extends from the second separation line such that the first accommodating portion, the second accommodating portion, and the third accommodating portion are arranged in a zigzag manner.

12. The package according to claim 11, wherein the first separation line and the second separation line are perforations through which slits intermittently penetrate at least the first resin sheet.

13. The package according to claim 12, wherein the first separation line and the second separation line deform the first resin sheet in the non-welded region.

14. The package according to claim 11, wherein a region corresponding to an intersection of a first separation line and a second separation line in the non-welded region is formed between a corner portion of the first resin sheet and a corner portion of the second resin sheet, and includes the gap.

15. The package according to claim 11, wherein the first separation line and the second separation line intersect to form a three-way junction.

16. The package according to claim 11, wherein a maximum length of the non-welded region along an extension line of the first separation line or the second separation line is 6 mm or less.

17. The package according to claim 11, wherein in a state where the first and second separation lines are not separated, the gap is not exposed to the outside.

* * * * *